United States Patent [19]

Trevarrow

[11] 4,304,034

[45] Dec. 8, 1981

[54] METHOD OF MAKING A WHEEL AND WHEEL MADE THEREBY

[76] Inventor: David Trevarrow, 119 Reiniche, Horton, Mich. 49246

[21] Appl. No.: 19,967

[22] Filed: Mar. 12, 1979

[51] Int. Cl.[3] ..... B21D 53/26; B21K 1/32

[52] U.S. Cl. ..... 29/159.01; 29/159 R

[58] Field of Search ..... 29/159 R, 159.01, 159.2, 29/159.3

[56] References Cited

U.S. PATENT DOCUMENTS

| | | | |
|---|---|---|---|
| 2,703,994 | 3/1955 | Mezey | 408/40 |
| 3,266,296 | 8/1966 | Hall | 29/159.1 |
| 3,530,717 | 9/1970 | Gregg | 29/159.1 |
| 3,580,043 | 5/1971 | Gollwitzer | 29/159.1 |
| 3,581,550 | 6/1971 | Waterbury | 29/159.1 |
| 3,688,373 | 9/1972 | Gregg | 29/159.01 |
| 3,834,212 | 9/1974 | Roper | 72/354 |
| 3,855,837 | 12/1974 | Phillipp | 29/159.01 |
| 4,143,449 | 3/1979 | Main et al. | 29/159.1 |

FOREIGN PATENT DOCUMENTS

| | | | |
|---|---|---|---|
| 2302631 | 7/1974 | Fed. Rep. of Germany | 29/159.1 |

*Primary Examiner*—Lowell A. Larson

*Attorney, Agent, or Firm*—Ralph J. Skinkiss; William P. Hickey

[57] ABSTRACT

A method for making a wheel and a wheel so made is disclosed in which the tire bead seats in the rim are deformed inwardly, the wheel is held by the deformed bead seats, and the bolting surfaces of the web are machined in fixed relation to the bead seats. Preferably, the bead seats are deformed sequentially to work welded metal attachment of a web to the rim, and then place it under compression. Preferably, the bolting surface is machined in the form of a flat cone that is approximately three degrees from planar, and the lug holes are chamfered to place surrounding metal in direct compression, and to deform the conically shaped bolting surfaces into flat engagement with planar surfaces on the hubs on which the wheels are to be installed. A method of determined angularity of the web to the rim is utilized to reject poorly aligned webs before machining the bolting surfaces, and thereby prevent undo thinning of the web, and as a means of product control. Theory of the stresses in the wheel both during manufacturing and use is disclosed.

23 Claims, 16 Drawing Figures

METHOD OF MAKING A WHEEL AND WHEEL MADE THEREBY

BACKGROUND OF THE INVENTION

The present invention relates to method and apparatus for forming a wheel in a manner which overcomes difficulties which the prior art has had with fatigue failures of the web and its attachment to the rim.

When prior art wheels have been run with overloads to induce failure, fatigue cracks have usually occurred in the center of the web where it is attached to its supporting axle. When the wheels have been fabricated utilizing welding, failures have also occured in the welds which have attached the rim to the web. The failures in these areas of the wheel have been so apparent to the industry, that an axiom has developed in the automotive industry that you do not machine or diminish the thickness of the web, since it is the "weakest link in the chain". On the other hand, the art has been reticent about using reinforcing plates for the web, not only because of their expense, but because of the weight which they would add to the rotating mass which must be accelerated and decelerated during the starting and stopping of the vehicle. Furthermore, in the interest of fuel economy, the industry is making great efforts to reduce the weight of automobiles, and any weight added to a wheel not only adds to the total weight of the vehicle, but more importantly, adds to the rotating mass which must be started and stopped.

On the other hand, everyone recognizes that wheels are critical to the safety of an automotive vehicle. What makes the problem of wheel design even more difficult is that the analysis of stresses in the metal of the wheel is complicated by many factors which seemingly defy accurate appraisal including tire unbalances, radial eccentricities of the rims which in turn support the tires, tolerances that are necessary for economical manufacture, and stresses that are created by the manufacturing processes used in forming the wheels. In the light of all these variables, and the inability to accurately calculate or predict the stresses involved; the problem of how best to form a wheel in a commercially feasible manufacturing process, and at a cost which the average consumer can afford, has continued since the start of the automotive industry.

In the light of this background, it is a principle object of the present invention to provide a new and improved method of manufacturing a wheel which overcomes problems of fatigue failures in the web and in its attachment to the rim.

Another object of the present invention is the provision of a new and improved apparatus for automatically carrying out the method of the present invention.

A further object of the present invention is the provision of new and improved wheels whose design overcomes stresses produced by alignment and bolting problems.

Further objects and advantages of the present invention will become apparent to those skilled in the art to which the invention relates from the following description of the preferred embodiments.

DESCRIPTION OF THE PREFERRED EMBODIMENTS

In order to fulfill the above objectives, it may be possible to clamp the web of a roughly formed wheel and deform its rim and precisely position it with respect to the plane of the clamped web. In the preferred embodiments, however, the rim is deformed by radially inwardly moving dies that are positioned as accurately as possible to center the inner ends of the dies with respect to tooling for the web. Any resulting radial mismatch does not appear critical, and the prohibition against machining of the web appears not to apply to the wheels produced by the present invention.

Figure 1:
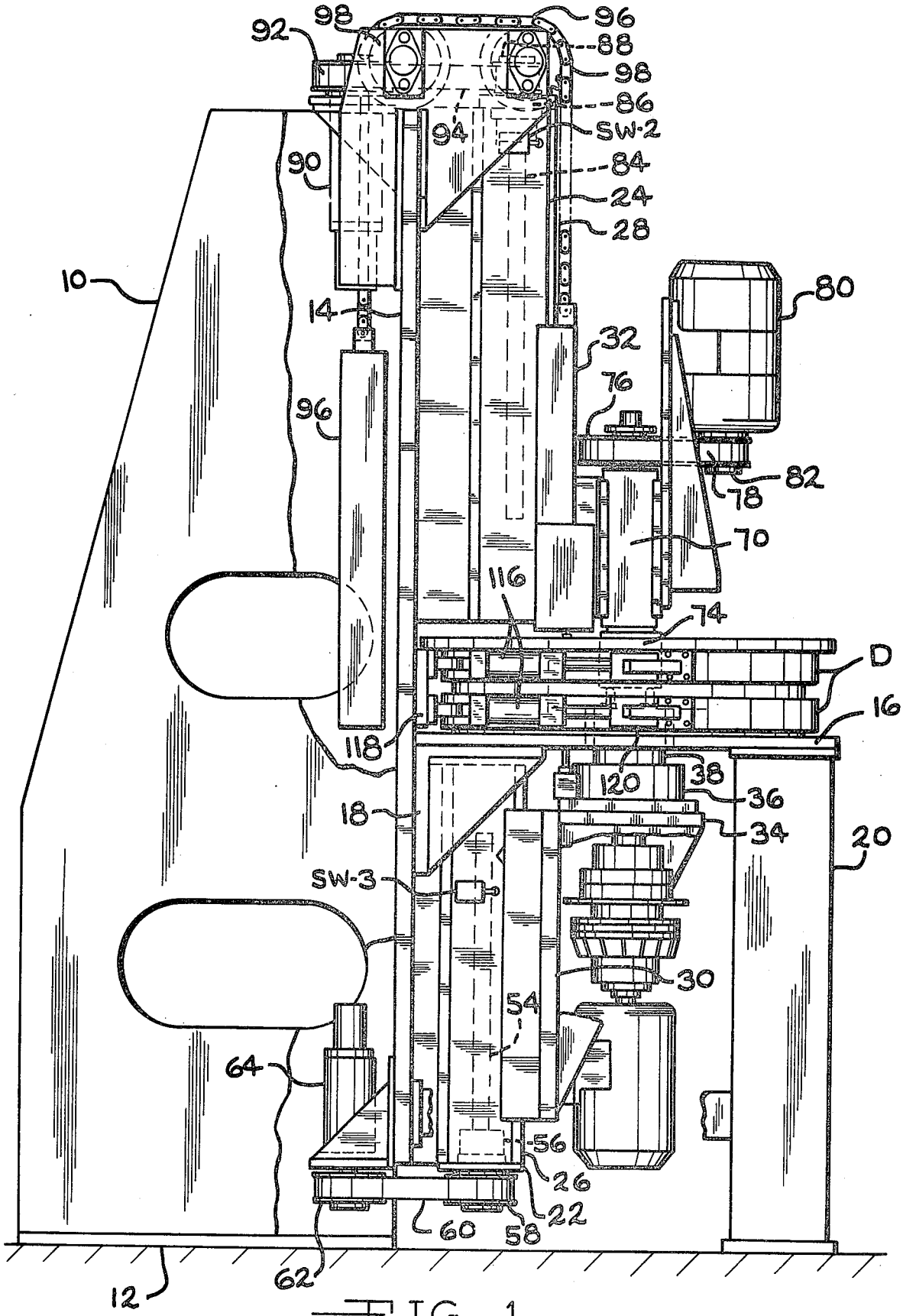
FIG. 1 is a side elevational view of apparatus which is constructed and which operates according to principles of the present invention.
Figure 2:
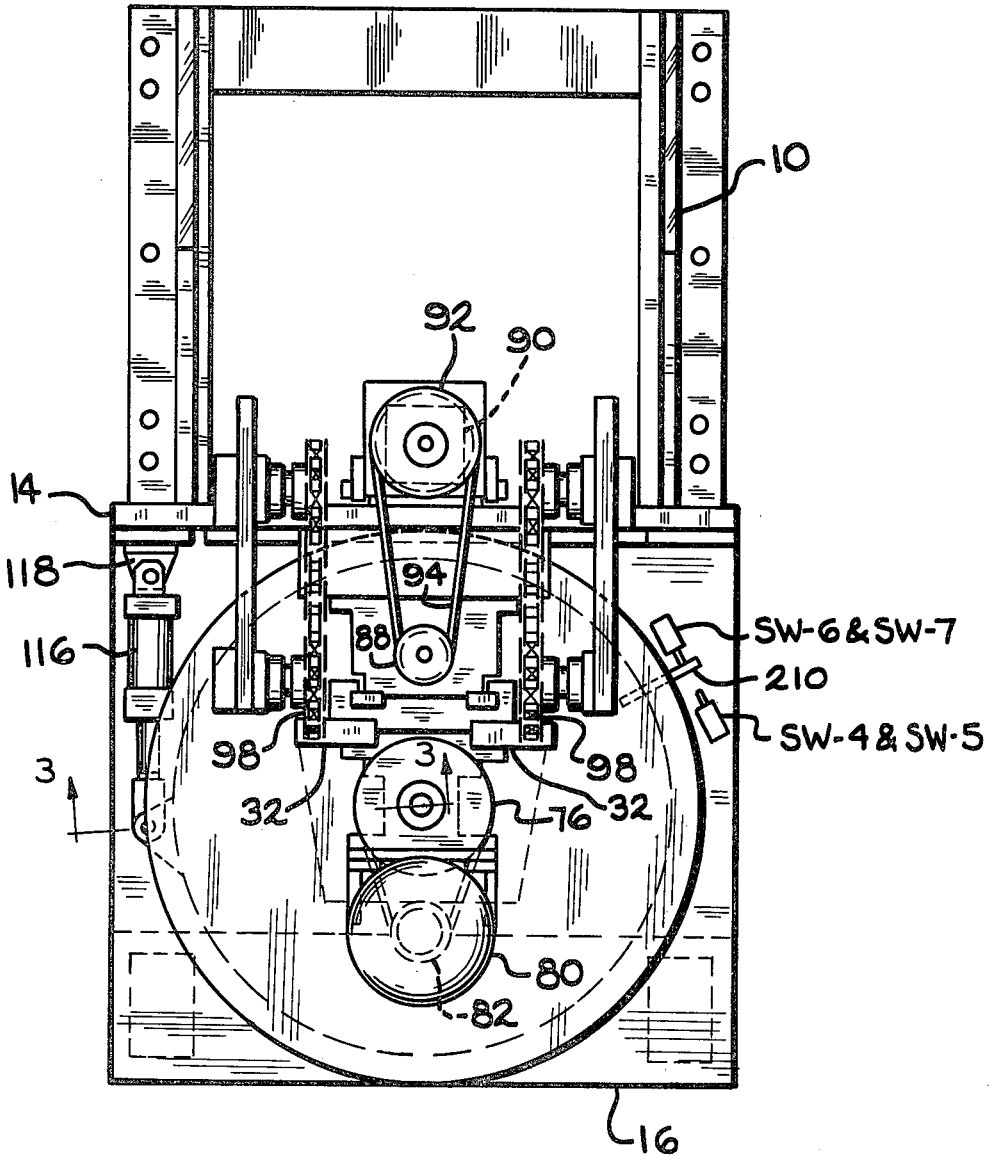
FIG. 2 is a plan view of the apparatus shown in FIG. 1.
Figures 6, 7:
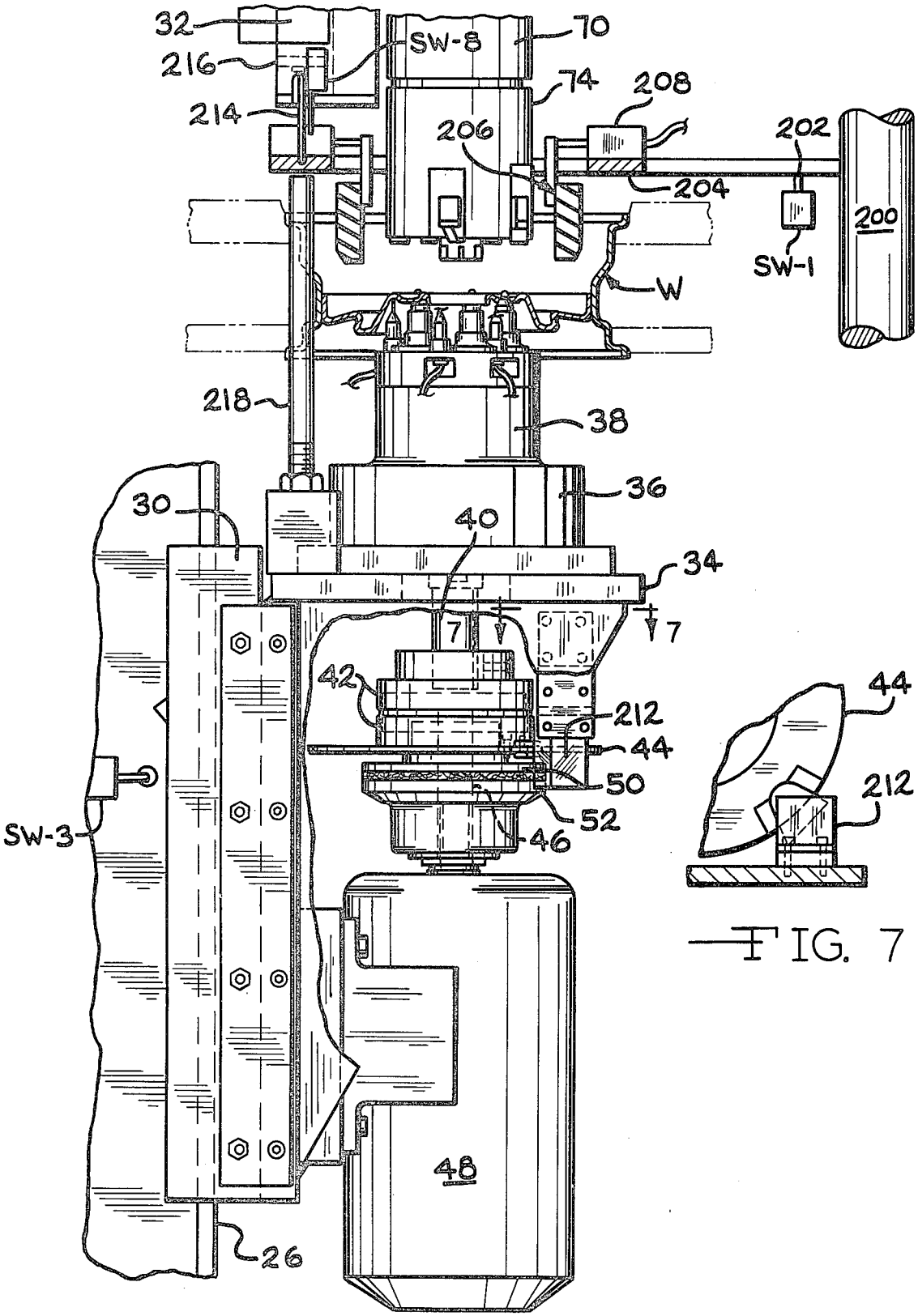
FIG. 6 is an enlarged fragmentary side elevational view, with portions broken away, and showing a wheel being worked upon by the apparatus.
FIG. 7 is a fragmentary sectional view taken approximately on the line 7—7 of FIG. 6.
Figure 8:
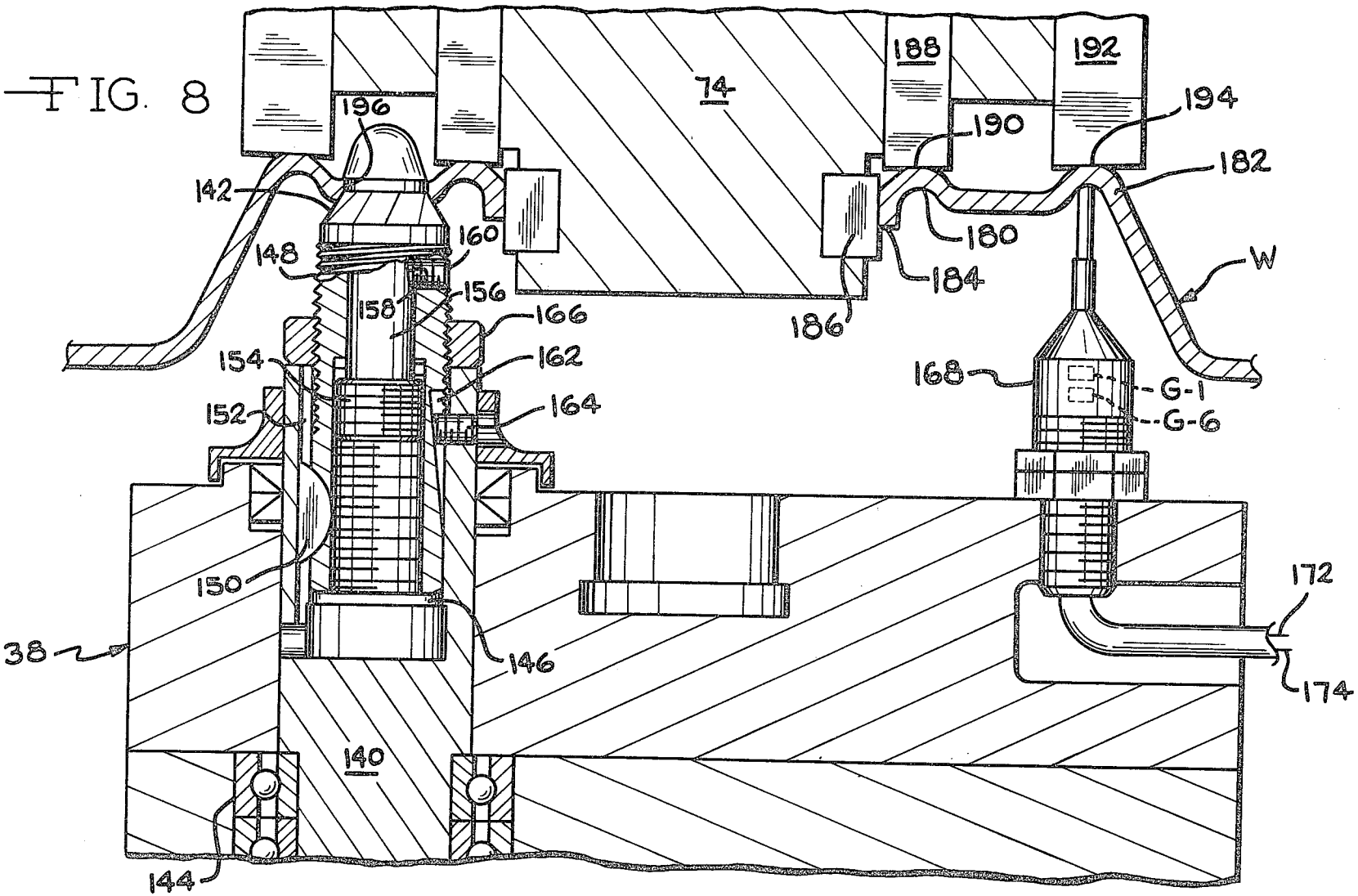
FIG. 8 is a greatly enlarged view of a wheel being machined by the top and bottom machining heads shown in FIG. 6.

As best seen in FIGS. 1, 2 and 6, the apparatus of the present invention generally comprises an upright frame 10 that stands upon a base plate 12, and which is faced with a vertical plate 14 to which components of the machine are bolted. A work station frame 16 is provided approximately half way up the facing plate 14. The inner end of the frame 16 is bolted to the facing plate 14 by means of a pair of angular brackets 18, while the outer ends of the work station frame 16 are supported by a pair of pedestals 20. The work station frame 16 in turn supports wheel deforming dies D, which will later be described in detail. A bolt-on way-frame 22 is secured to the facing plate 14 beneath the work station frame 16, and another bolt-on way-frame 24 is fastened to the facing plate 14 above the work station frame 16. The bolt-on way-frames 22 and 24 carry way surfaces 26 and 28, respectively, which are carefully aligned at right angles to the work station frame 16.

A lower slide 30 is hung off of the lower way surfaces 26 for movement toward and away from the bottom surfaces of the work station D, and an upper slide 32 is hung off of the way surfaces 28 for movement toward and away from the upper surface of the work station D. A horizontal bearing plate 34 is suitably affixed to the upper end of the lower slide 30, and the bearing plate 34 in turn supports a bearing housing 36 for a multiple spindle machining head 38 that projects from its upper end. A centrally located drive shaft 40 for the head 38 extends out of the bottom of the bearing housing 36, through an opening in the bearing plate 34, into the top half of an alignment coupling 42. The bottom half of the alignment coupling 42 is secured to the top of a brake disc 44 and the two are suitably journaled about the projecting end of the shaft 46 of an induction drive motor 48. The top plate 50 of a friction clutch is secured to the bottom of the brake disc 44, and the bottom plate 52 of the friction clutch is nonrotatably secured to the motor shaft 46 by a suitable keyway.

The lower slide 30 is moved upwardly toward the work station D and downwardly away from the work station D by means of a ball lead screw 54 that is suitably received in the structure of the lower slide 30, and the shaft of which projects through bearing structure 56 that is fixed to the bottom of the lower way frame 22. The bottom of the shaft of the ball lead screw 54 is fixed to a cleat pulley 58 that is driven by a nonslip cleat belt 60. The cleat belt 60 is in turn driven by a similar pulley 62 that is affixed to the shaft of a vertically oriented servo drive motor 64 that is supported on the back side of the facing plate 14. The servo drive motor 64 is adapted to move the lower slide 30 upwardly at two different speeds, and to stop the lower slide 30 at a precise relative position to a wheel in the work station D, as will later be explained in detail.

The upper slide 32 is arranged for movement parallel to the bottom slide and carries a tubular spindle housing which journals a single spindle 72, the lower projecting end of which carries the upper machining head 74. The spindle 72 is driven by a belt pulley 76 that is in turn driven by a drive belt 78. An induction motor 80 is supported by the spindle housing 70 parallel to the spindle 72 and drives the belt 78 by means of a drive pulley 82.

The upper slide 32 is arranged to be withdrawn a considerable distance above the work station D in order that wheels can be loaded into and unloaded out of the top of the work station D. To facilitate loading and unloading, the slide 32 is provided with drive mechanism which provides a fast advance and retraction, a fast feed downwardly, followed by a slow feed downwardly. Slide 32 is driven by a vertical ball lead screw 84, the lower end of which engages structure of the slide 32. The upper end of the shaft of the lead screw 84 extends through a bearing housing 86 fixed to the upper end of the way frame 24, and is driven by a cleat pulley 88. Cleat pulley 88 is in turn driven by a servo drive motor 90 whose shaft projects up from the upper end of the frame 10 and carries the drive cleat pulley 92. Cleat pulleys 86 and 92 are opposite each other, and are connected by a nonslip cleat belt 94. In order to aid the precision with which the servo drive motor 90 can position the upper slide, particularly during rapid advance, the slide 32 is counterbalanced by a weight 96, which is positioned on the back side of the facing plate 14, and which is connected to the slide by a pair of roller chains 96. The roller chains pass over sprockets 98 that are suitably supported on the upper end of the frame of the machine. The upper slide 32 of the machining head is shown in its lowermost machining position in FIGS. 1 and 6 of the drawings; and it will be understood that the slide 32 and machining head 74 will be adjacent the top of the frame of the machine during loading and unloading of wheels into the work station D.

Figure 3:
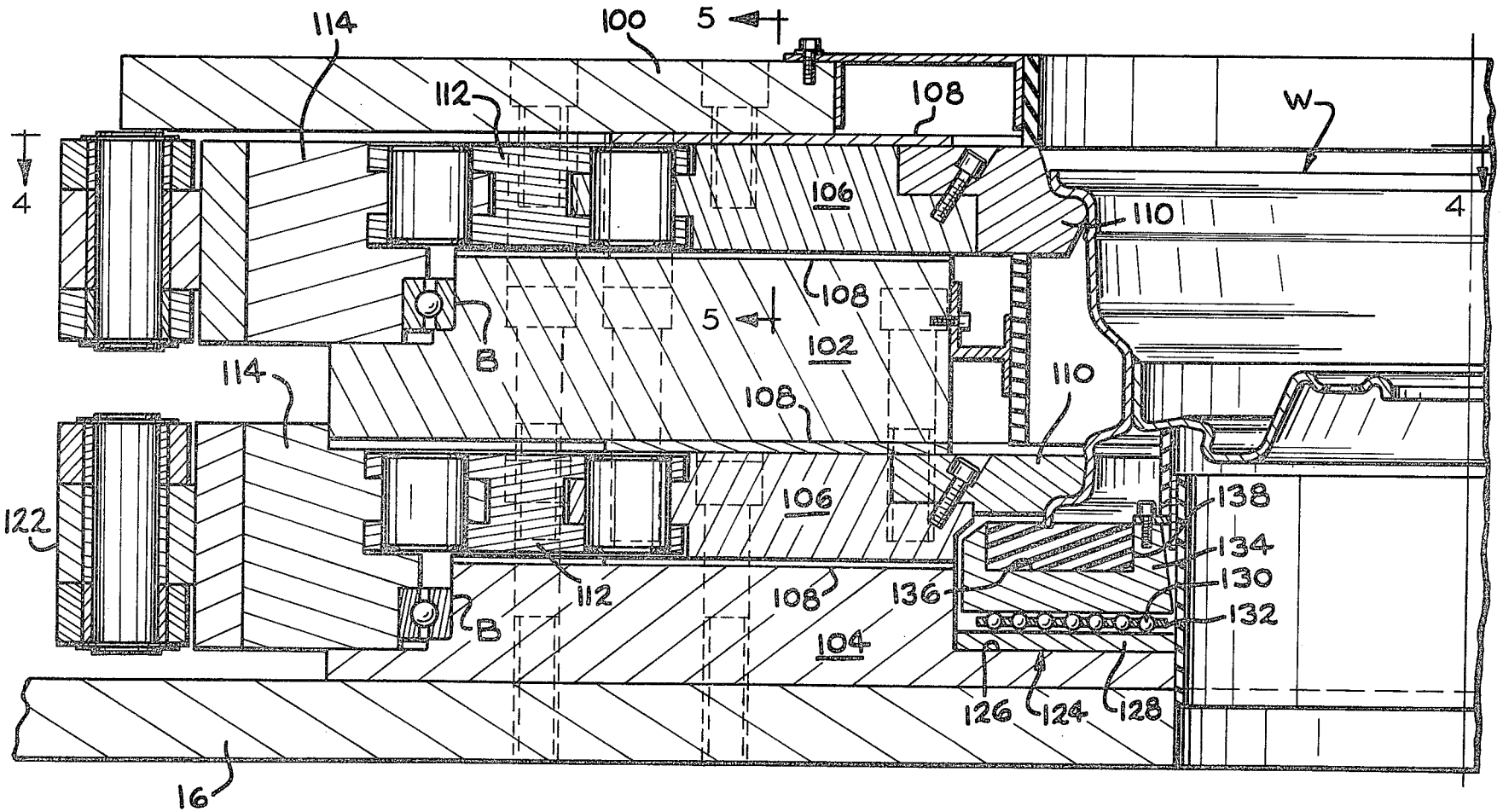
FIG. 3 is a fragmentary enlarged sectional view taken approximately on the line 3—3 of FIG. 2.
Figure 4:
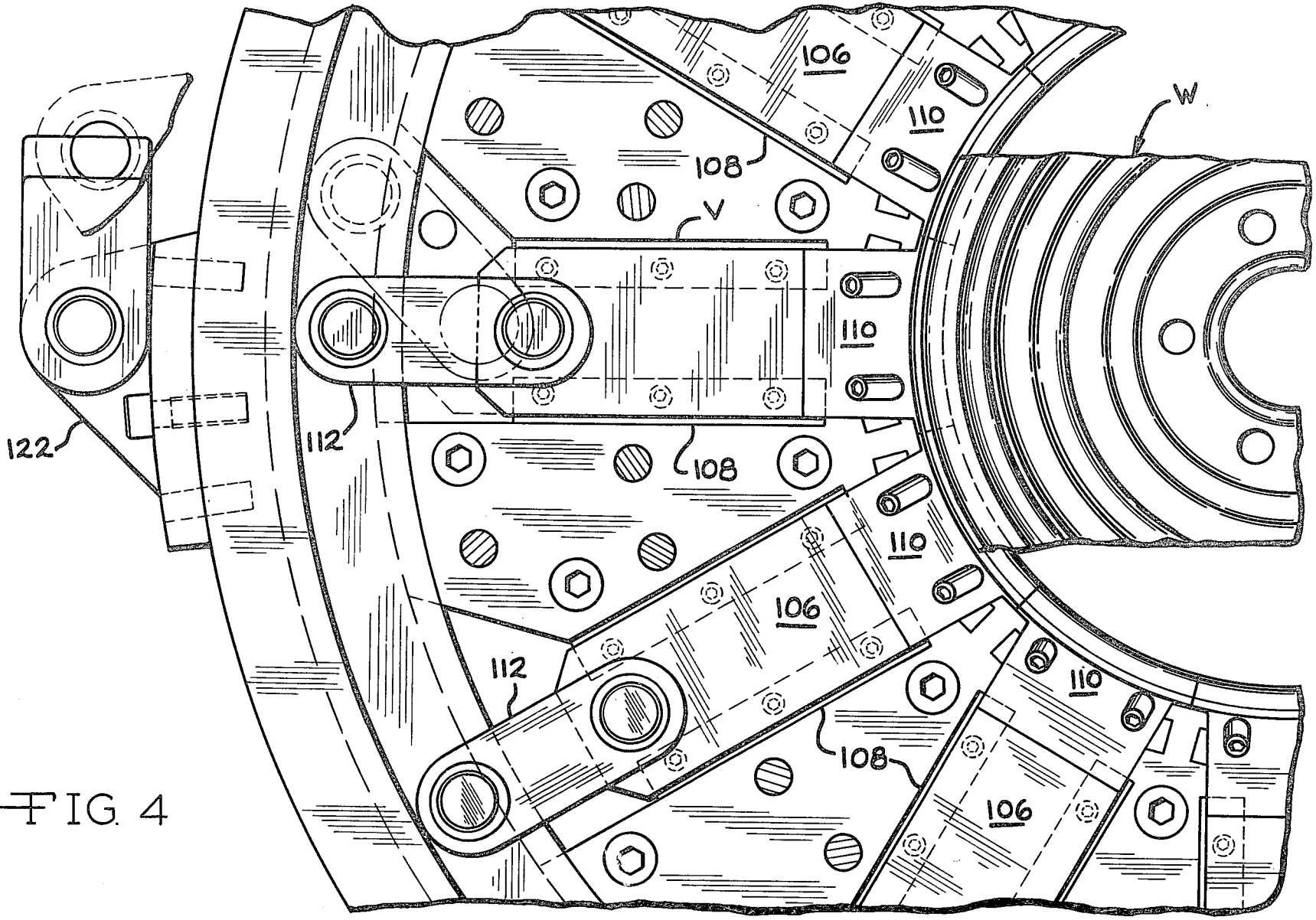
FIG. 4 is an enlarged fragmentary sectional view taken approximately on the line 4—4 of FIG. 3.
Figure 5:
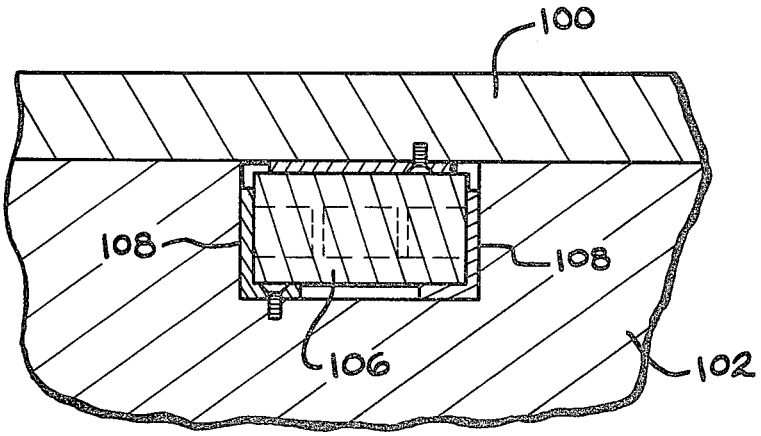
FIG. 5 is a fragmentary sectional view taken approximately on the line 5—5 of FIG. 3.

In the apparatus shown in the drawings, a rim shrinking die assembly D is located at the work station D, and is fastened to the top surface of the working station frame 16 precisely concentric with the axis of rotation of the lower machining head 38 and the upper machining head 74. The die assembly D is generally a self-contained unit comprising: upper, middle and lower die plates 100, 102 and 104, respectively, that are suitably contoured and bolted together to provide support for a plurality of radially extending master jaw slides 106, and their L-shaped brass guide plates 108. The L-shaped die plates 108 are suitably fixed to the upper, middle and lower die plates 100, 102, and 104, as the case may be, by suitable fasteners, not numbered. The inner ends of the jaw slides 106 are provided with hardened jaw tips 110 that are suitably shaped to abut the bead surfaces of the rim of an automotive vehicle and deform the bead surfaces radially inwardly. The outer end of the jaw slides 106 have toggles 112 suitably pinned thereto, and the outer end of the toggles 112 are suitably pinned to an appropriate one of a pair of actuating rings 114 which extend 360 degrees around the outside of the jaw slides 106. The lower actuating ring 114 is journaled to the outside of the lower die plate 104 by an antifriction bearing B comprising inner and outer raceways and a plurality of balls; and the upper actuating ring 114 is journaled to the middle die plate 102 in a like manner by an identical friction bearing B. The actuating rings 114 are adapted to be rotated approximately ten degrees by respective upper and lower hydraulic actuating cylinders 116 that are best seen in FIGS. 1 and 2. The cylinder end of the actuating cylinders 116 are suitably pinned to the facing plate 14 by suitable bifurcated brackets 118, and the piston rods of the actuating cylinders 116 are provided with bifurcated fittings 120 that are pinned to ears 122 that are welded to the appropriate actuating ring 114. Expanding the hydraulic cylinders 116 causes the actuating rings to move the toggles 112 from the dot-dash position shown in FIG. 4 to the solid position shown in FIG. 4, and in turn move the jaws 106 from their radially outer positions to the irradially inner positions shown in FIGS. 3 and 4 of the drawings.

As previously indicated, wheels to be trued are fed to the apparatus shown in the drawing when the upper slide 32, and upper machining head 74 which it carries, are moved to the upper end of the frame free and clear of the work station D. The wheels are fed by a conveyor and work transfer means to a position over the work station D and are lowered into position so that the bead seats of the wheels rim is opposite the jaws 110. According to principles of the present invention, the wheel is supported in the appropriate position opposite the jaws 110 by a work support table 124 of unique construction and which is about to be described. As shown in the drawings, the work support table 124 is an annular table on which the lower rim of the wheel sets when the bead seats of the rim are opposite the jaws 110. In the present instance, the work support table 124 is supported in an annular recess 126 in the lower die plate 104. An annular bottom support plate 128 fits into the recess 126, and a plurality of identically shaped balls 130 are held by a cage plate 132 in spaced apart positions extending around the top surface of the plate 128, for the support of a thick annular surface plate 134. The surface plate 134 contains an annular groove 136 in the area beneath the innermost travel of the jaws 110, and an annular hard rubber surfacing disc 138 is positioned in the groove 136 for the support of the edge of the rim of the wheel being worked upon. The rubber surfacing disc 138 is of a thickness and resiliency which will accommodate lateral deflection of the edge of the rim as occurs when the opposing jaws 110 deform the bead seats of the rim radially inwardly. In addition, the rubber surfacing material 138 is of a lubricious nature which permits the edge of the rim to shift laterally during the time that the rim is being deformed radially inwardly. In addition, the whole surfacing plate 134 can move laterally over the top of the balls 130 to center the rim prior to its deformation by the jaws, should this be necessary to equalize forces around the rim. It will be seen that the work support table 124, therefore, will support the wheel in an approximate position, so that it can be caught by the jaws 110 and the table shifted laterally to provide an initial centering action. Thereafter the table permits the rim of the wheel to be pushed down into its resilient surface by whatever amount is necessary to accommodate the deflection of the rim as it is being deformed radially inwardly to the proper bead seat diameter.

Figure 9:
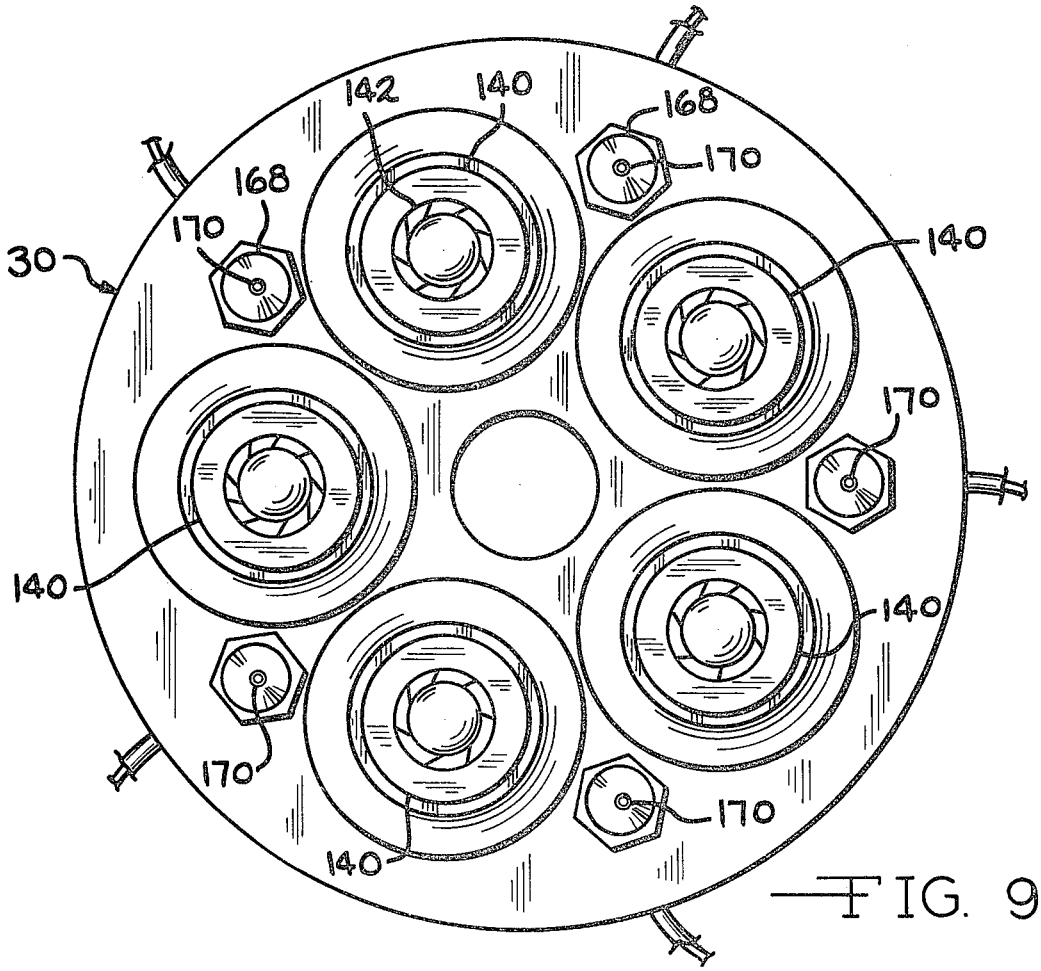
FIG. 9 is a plan view of the bottom machining head.

After the rim deforming dies have trued the bead seats, the lower slide 30 and multiple spindle machining head 38 which it carries, moves up against the bottom surface of the web of the wheel to chamfer the lug holes by which it will be fastened onto the hub of the axle of an automotive vehicle. In the embodiments shown in the drawings, and as best seen in FIG. 9, the multiple spindle machine head 38 being described has five spindles 140 each of which carries a conical cutter 142 appropriately tapered to chamfer the lug holes of the web of the wheel. Each of the spindles 140 are journaled by antifriction bearings 144, and are rotated by suitable gearing (not shown) that in turn is driven by the drive shaft 40. Spindle 140 is bored out at its upper end, as at 146, to receive a tubular tool holder 148. The lower end of the tubular tool holder 148 has a woodruff key 150 lodged therein, which in turn slides in a keyway 152 that extends longitudinally of the inner wall of the spindle 140. The lower end of the tool holder is counterbored and threaded to receive a set screw 154 that is adjustable against the bottom end of the shank 156 of the cutter 142. The shank 156 has a wedge shaped groove 158 longitudinally thereof, into which a set screw 160 is tightened to hold the cutter 142 down into engagement with the set screw 154. The tool holder 148 in turn has a wedge shaped groove 162 into which a set screw 164 is tightened to lock the tool holder to the spindle. In addition, the upper end of the tool holder 148 is threaded, and a threaded lock nut 166 is tightened down onto the end of the spindle 140 to lock the tool holder in place.

The lower multiple spindle head 38 also carries a plurality of gauging switches spaced evenly around the head beneath the outer annular bolting surface of the web that is to be machined by the top slide, as will later be described. The gauging switches 168 are precisioned instruments and have contact pins 170 that extend down into the body of the switches to sequentially open a first switch and then close a second switch after approximately 0.0030 inch of travel. The first switch controls the energization of wire 172 and the second switch controls the energization of wire 174.

The inner face of the wheels being trued are stamped with inner and outer concentric rings 180 and 182, respectively, and an outwardly bent tubular portion 184 for bearing contact with the axle hub of the automotive vehicle on which it is to be installed. The upper head 74 contains a set of concentric cutters 186 suitably held for feeding axially through the tubular portion 184 to give it a cylindrical machined surface for gripping the hub. The head 74 also contains another set of spaced apart milling cutters 188, the bottom ends of which are beveled at approximately a three degree angle to the horizontal for milling a flat bolting surface 190 on the inner surface of the ring 180. The head 74 is provided with another set of milling cutters 192, the end surfaces of which are also tapered at a three degree angle for milling a bolting surface on the inner ring 182. The cutters 188 and 192 have their cutting surfaces aligned so that their revolution defines the surface of a flat cone which forms an angle of 93 degrees with the cylindrical surface that is machined on the tubular portion 184 by the cutters 186. The metal between the bolting surfaces 190 and 194, and which contain the lug holes 196, is bent outwardly at approximately a 45 degree angle. The cutters 142 are beveled at approximately a 60 degree angle so that a lug that is tapered at approximately a 45 degree angle will put the metal between the lug and the holding surfaces 190 and 194 in direct compression. When the wheel is abutting a radial surface, the web is bent at a point outwardly of the outer bolting surface 194 enough to cause the bolting surfaces 194 and 190 to become planar against the radial surface of the hub on which the wheel is being bolted. The surfaces 190 and 194 at this time will be flat against the radial surface, with their full machined surface in contact therewith to keep bearing stresses at a minimum. In addition, the deflection of the center portion of the web as above described will cause the outer end of the tubular portion 184 to be shrunk radially inwardly to tightly grip and center the web on the cylindrical portion of the hub of the axle on which the wheel is being bolted. It will further be seen that the apparatus of the present invention causes the bolting surfaces 190 and 194 to be absolutely true with respect to the plane passing through the trued bead seats, so that the bead seats run absolutely true with the axle of the vehicle.

It has been found that the wheels of the present invention have greater service life than do wheels that are identically made, but which have not have the bolting surfaces 190 and 194 machined, even though the rims have been deformed radially concentric with the lug holes. The reasons why this is so are not fully known at this time, but it is believed that this fact shows that the angular misalignment of the bolting surfaces of the web with respect to the rim, causes the metal of the web to be fatigued by axially changing stresses as the tire rolls over paved surfaces, and that the present invention greatly reduces these stresses.

As previously indicated, the wheels are loaded and unloaded from the mechanism above described by a transfer mechanism which takes the wheels from a conveyor and loads it onto the work table. After the wheel is machined, the transfer mechanism moves the wheel up out of the dies, and then indexes to bring another wheel into position. This mechanism is shown schematically in FIG. 6. The mechanism comprises a vertical shaft that both rotates and moves vertically up and down, and a plurality of arms 202 which carry rings 204 that are to be centered over the work station. Each ring 204 has a plurality of levers 206 pivoted thereto. The bottom end of the levers 206 grip the rim of the wheel, and the upper end of the levers are moved in and out by air cylinders 208 to produce the gripping action. A switch SW-1 is shown schematically as positioned beneath the position of the arm 202 after it has loaded a wheel onto the supporting table 124, and when the switch SW-1 is actuated, it initiates the operation of the machine about to be described.

At the time that a wheel is lowered onto the work table 124, the upper slide 32 is in engagement with the switch SW-2 at the upper end of the frame, and the lower slide 30 is in engagement with the home position switch Sw-3—in which position, the multiple spindle head 38 is just beneath the rim of the wheel resting on the table 124. The air cylinders 208 unclamp the wheel at the time SW-1 is actuated, and simultaneously therewith, the lower chuck actuating cylinder 116 is actuated to move a trip dog 210, carried by the lower chuck actuating ring 114, from the chuck retracted switch SW-4 into engagement with the chuck advanced switch SW-6. Shortly thereafter, the dog 210 on the top actuating ring 114 moves out of engagement with the chuck retracted switch SW-5, and into engagement with the chuck advanced switch SW-7. When both switches SW-6 and SW-7 are actuated, the servo motor 64 which actuates the bottom slide, and the servo motor 90 which actuates the top slide, become actuated. It will be understood that the drive motor 48 of the bottom machining head 38, and the drive motor 80 for the upper machining head 74 are rotating at this time since they operate continuously once the electrical system for the machine is energized. Shortly after the bottom slide starts upwardly, the cutters 142 start the countersinking of the various lug holes. Shortly after the countersinking starts, the contact pins 170 which are positioned beneath the cutting surfaces of the cutters 140 and 142 start to engage the web. As previously indicated, the contact pins 170 on initial contact with the web actuate a first switch contact therein (which will be designated G-1 through G-5 for each of the five gauging switches 168). Upward movement of the bottom slide will continue until such time as the second switch contact of the first gauge 168 is actuated. These contacts will be designated G-6 through G-10. If at the time that the first of the second switches contacts G-6 through G-10 are actuated, all of the switches G-1 through G-5 have been actuated, the web is deemed to be within angular tolerance, and the operation of the machine will continue as will later be described. If, however, all of the contacts G-1 through G-5 are not actuated at the time the first of the contacts G-6 through G-10 are actuated, the wheel is deemed to be defective, and the operation of the machine is interupted to retract the chucks and remove the wheel from the machine.

Assuming that the web is within angular tolerance, the servo motor 64 is caused to remain stationary, the clutch 42 for the lower spindles is deenergized, and a caliper brake 212 is actuated to clamp the brake disc 44 and stop rotation of the bottom spindles.

As previously indicated, the servo motor 90 for the top slide was actuated at the same time that the servo motor 64 for the bottom slide was actuated. The initial actuation of the servo motor 90 causes the top slide 32 to move downwardly at a fast advance speed until the actuating pin 214 of a gauge switch 216 carried by the top slide 32 is caused to engage an abutment rod 218 that is carried by the bottom slide 30. The abutment rod 218 is adjustable and sticks up vertically from the top surface of the bottom slide 30 through the work station D to be engaged by the actuating pin 214. Gauge switch 216 contains two contacts G-11 and G-12, the first of which is actuated upon immediate contact of the pin 214 with the rod 208 to stop the fast advance of the top slide 32, and start a fast feed movement for the slide which causes the axial cutters 186 to move through the tubular bent portion 184 of the wheel with a lateral machining feed. After the bottom edge of the cutters 186 have proceded past the bottom edge of the tubular portion 184, contact G-12 of the switch 216 is actuated to start a slow speed actuation of the servo motor 90 that causes the cutters 188 and 192 to move into end milling abutment with the concentric rings 180 and 182 of the rim to machine the concentric bolting surfaces 190 and 194.

While the machining of the bolting surfaces 190 and 194 is taking place, chamfer cutters 142 are held stationary and into tight engagement with the web of the wheel. During this time, servo motor 64 opposes any movement of its rotor out of its set position. After a further predetermined movement of approximately 0.010 inches of the slide, another switch SW-8 contacts the top surface of the post 218 to deenergize the top servo motor 90 and thereby limit the depth of cut of the bolting surfaces 190 and 194. A timer causes the drive 80 for the cutters to continue rotating for a brief period until the cutters clean up the surfaces 190 and 194. After the dwell timer times out, servo motors 64 and 90 are both reverse energized to retract the slides 30 and 32 simultaneously. Since the bottom slide 30 has the shortest distance to travel, it hits the home switch SW-3 shortly thereafter, and causes the bottom servo motor 64 to be deenergized.

At the same time that the servo motors 64 and 90 were reverse energized by the timer, both cylinders 116 were actuated for retraction to bring both dogs 110 into engagement with switches SW-4 and SW-5. After switches SW-4 and SW-5 are actuated, a suitable time delay is produced by a timer to allow the top slide 32 to move free and clear of the work station D. When the timer times out, it causes the air cylinders 208 to be actuated to grip the wheel and the vertical shaft 200 of the transfer mechanism to start upwardly. The shaft 200 then rotates to move the machined wheel away from the machine and bring a new wheel into position for lowering onto the work support table 124. By this time, the top slide 32 will have reached the top home position switch SW-2 to actuate the same. When the arm 202 of the transfer mechanism has moved downwardly to lower the wheel into proper position, it actuates the switch SW-1 and the cycle is repeated.

A method of manufacture, utilizing the apparatus and procedure above described is depicted schematically in FIG. 10 of the drawings. FIG. 10 depicts a method of making a wheel wherein a strip of metal is rolled into a cylinder FIG. 10*a* and the ends are butt welded together to provide a blank FIG. 10*b* that is slightly larger in diameter than are most of the surfaces of the rim of the wheel which is to be made. The cylinder is then rolled into an approximate shape FIG. 10*c* that provides a drop center and opposing tire bead seats. This rolling process, it will be understood, produces parts whose dimensions not only vary from one another, but vary from the specification of the wheel which is to be made. During the rolling of the rim, a slight deviation in the way the metal flows, occurs and the bead seats may zig zag laterally from a true surface of revolution. In addition, the rim may be slightly egg shaped.

Figure 10D:
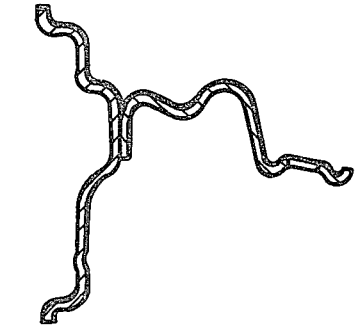
FIG. 10 is a compilation of fragmentary schematic diagrams 10*a* through 10*g* depicting various steps in the preferred process of the present invention.
Figure 10C:
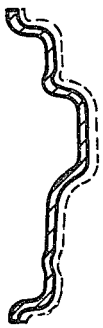
Figure 10B:
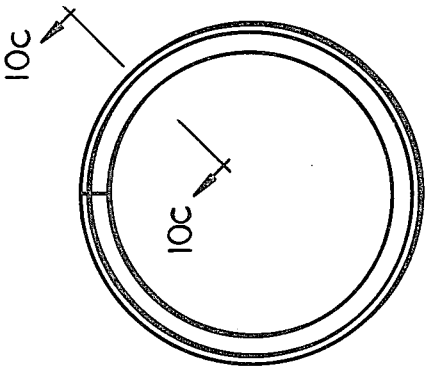
Figure 10A:
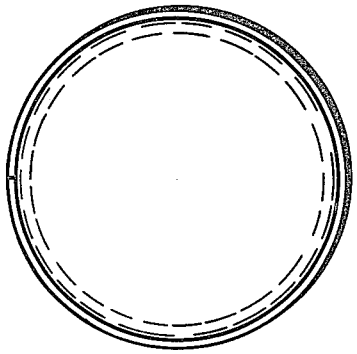
Figure 10G:
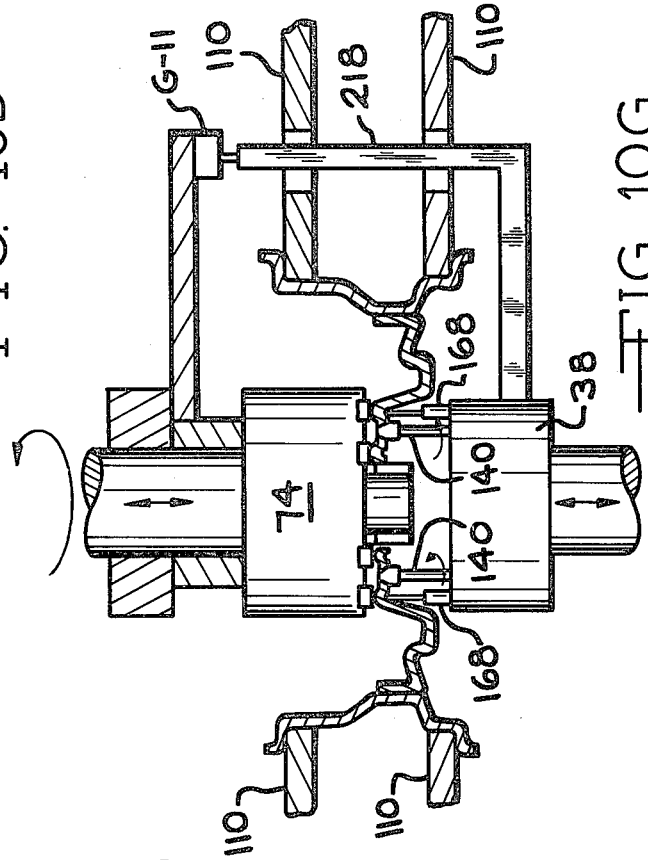
Figure 10F:
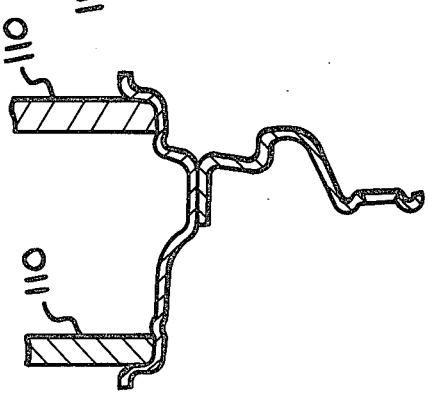
Figure 10E:
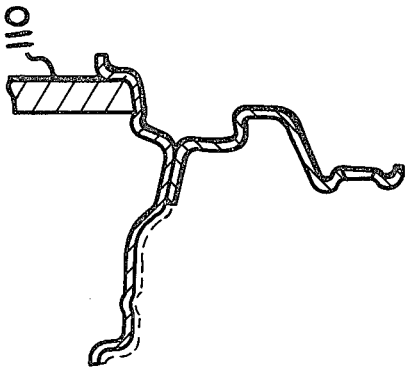

After the rim blank is rolled into an approximate shape, a stamped spider or web having two concentric ridges, and conically deformed metal surrounding punched lug holes, is placed into approximate position within the rim FIG. 10*d*, and the two are welded together. With such an inaccurate rim, it is not possible to support the rim in the welding machine in an exact position relative to the web, nor in a position that is consistent from one wheel to another. The web that is welded to the rim, therefor, will only be in an approximate position angularly and radially with respect to the bead seats.

In any mass production process, each piece being made cannot be measured individually and its shape adjusted with respect to reference points on the wheel itself. Mass production machinery must perform operations with respect to its own reference surfaces, and the errors produced by using reference surfaces on the machine instead of reference surfaces on the parts will add errors that contribute to the stack up of tolerances between the parts actually made and parts having desired dimensions. Another error which occurs in mass production processes arises by the selection of the dimensions that are deemed critical and those what dimensions which are deemed not critical; and the precision with which certain contours must be maintained in the pieces that are made. To my knowledge, the art has never mathematically analyzed all of the conditions and forces on a wheel, nor the stresses produced by its manufacture. Obviously, the selection of the dimensions which must be maintained, the precision with which they must be maintained, and the selection of steps to meet the selected criterion; all are a part of any method of mass producing an article.

According to the new and improved method of making the wheels shown in FIG. 10, the portions of the rim which form the bead seats are spread apart laterally and pushed concentrically inwardly to relieve the stresses produced by thermal shrinkage of the weld between the web and the rim. This is preferably done in a sequential manner FIGS. 10*e* and 10*f* as will later be explained. Tests of prior art mass produced wheels when overloaded have shown that failure usually occurs in the webs, and a strong feeling has been held by the art that the web should never be cut into. The prohibition against cutting into the web has been widely and deeply held by the industry. It will be understood, therefore, that the description which follows is not only a radical departure from accepted practice, but provides for removal of metal from a very critical location whose position changes both laterally and angularly from wheel to wheel.

According to the process depicted, the rim having the web welded thereto in an approximate position is deformed to give concentric tire bead seats. It will be understood that in any process involving deforming of metal, spring back of metal occurs; and as previously indicated, it is not possible to measure and treat each wheel separately. In the process depicted, apparatus is provided which performs machining operations relative to self contained reference surfaces on the machine rather than to reference surfaces on the individual wheels.

In the usual machining operations, a cutting tool is fed across the surfaces to be machined. In the process depicted, however, a revolving cutter on a slide is moved normal to the apparatus surfaces which grip and support the bead seats.

In the method depicted, at least one gauging switch is moved normal to the bead seat supporting surface and the actuation of its switch contact is used to determine the position of the web relative to the bead seat. Thereafter, the signal from the switch is used to control the depth of cut by the slide which moves normal to the bead seat supporting surfaces. In the specific process depicted, the gauging switches are mounted on a slide which moves against the opposite side of the web from the side being end milled (see FIG. 10*g*). Also in the specific process depicted, a plurality of gauging switches are used, and the signal from the last contact to be actuated is used as the reference position from which the predetermined depth of cut is made. Also in the specific process depicted, each gauging switch has a second contact that is actuated after a predetermined movement following actuation of the first contact, and this is used to sense when the web is beyond angularity limits.

Movement of a cutter flatwise against the work usually produces chatter, and this is overcome in the preferred embodiment by details later to be explained. In the machine shown, the gauging switches are on a separate head which moves axially against the side of the web opposite from the surfaces to be machined, and the machining head carries a switch which is moved down into engagement with the reference surface of the gauging table. (see FIG. 10*g*) The mechanism is arranged so that the machining head has a limited axial movement after its switch engages the reference surface of the gauging head to thereby limit the depth of the cut that is made on the web of the wheel being contoured. The gauging head and machining head need not be part of the same apparatus which deforms the rim. In the preferred embodiment, however, it is done in the same machine and in a position precisely located with respect to the limit of travel of the jaws, and before spring back of the workpiece occurs. In a further refinement of the process depicted, the metal which surrounds the lug holes is deformed conically out to the opposite side of the areas of the bolting surfaces being machined, and the chamfer cutters for machining the lug hole surfaces are carried by the gauging head. The chamfer cutters do their cutting during the gauging movement since the amount of metal which they remove is not deemed to be critical. It is a further feature of the process that chatter of the machining head is greatly diminished by holding the chamfer cutters stationary in their final cutting position while the machining head is rotated against the opposite surface of the web.

All of the advantages of applicant's process have not been numerated, but the sequence of steps described above permits a wheel to be made within dimensional limits. If the angularity of the web with respect to the rim is beyond acceptable limits, the wheel is rejected before machining of the web, so that the rejected wheel can have its web deformed in a separate more or less individual operation, and be fed back into the machining process again. Still other advantages of the sequence and manipulative steps given occur, and many of these will be apparent to those skilled in the art from the description that has been given.

According to a still further aspect of the invention, the two concentric bolting surfaces are machined to define a shallow cone making an angle of approximately 93 degrees with a normal to their axis of rotation; so that when the wheel is bolted in place, the machined surfaces will bend substantially planar to prevent chafing of the bolting surfaces.

It will now be seen that there has been provided a new and improved wheel whose web is accurately machined with respect to the tire bead surfaces, so that not only the tire bead seats and the bolting surfaces of the wheel are made concentric with the axis of rotation, but are made absolutely normal to each other. It has been found that wheels so made have a greater life expectancy than wheels having the same thickness of metal and which are similarly made excepting that the bolt surfaces are not machined. It is surprising that an increase in life is had, not withstanding the fact that metal has been removed from the web; and this is believed to be achieved by causing a reduction in the axial flexing that is produced on the web as it rolls over the pavement. Apparently, bead seats that are not accurately aligned perpendicular to the web cause the mass of the tire to be accelerated alternately in opposite directions to an extent depending upon the amount of angular misalignment of the web to the bead surfaces; and the reduction in these forces achieved by machining the bolting surfaces more than compensates for the reduction in strength of the web. As a further refinement, the wheel of the present invention has chamfered lug openings that are machined accurately with respect to the tire bead surfaces on cones of metal which extend outwardly from the machined bolting surfaces, so that the metal between the chamfered lug openings, and machine bolting surfaces, is placed substantially in compression to bend the bolting surfaces planar.

Further advantages are produced by the process of the present invention in that the metal in the weld between the web and the rim is favorably worked to reduce residual stresses therein. By sequentially deforming the rim on one side of the weld before exerting a restraining action on the other side of the weld, one side of the weld is compressed, while the other side is put under tension, followed by a reversal, and then places the weld under compression to offset the original tension in the weld which was produced when the weld metal cooled. The weld metal in the finished wheel, therefore, is more nearly at a zero residual stress than it had before being sequentially worked. In addition, the rim deforming forces are spread over a greater period of time, and the deforming forces are only approximately half of what would be required if both bead seats were deformed simultaneously. Less spring back of the finished deformed rim also appears to occur. This appears to be so both in wheels having a butt weld between the web and rim, and in wheels having a rolled over peripheral portion on the web which is fillet welded to the rim.

While the invention has been described in considerable detail, I do not wish to be limited to the particular embodiments shown and described, and it is my intention to cover hereby all novel adaptations, modifications, and arrangements thereof which come within the practice of those skilled in the art, and which fall within the purview of the following claims.

I claim:

1. A method of fabricating a wheel having a rim with opposing outer and inner bead seats and a web having a bolting surface for fastening onto a hub, said method comprising: forming a rim with outer and inner bead seats, forming a web that has outer and inner side surfaces, welding said web into said rim in a position that is approximately normal to said bead seats, deforming said bead seats radially inwardly to improve concentricity, supporting said bead seats by a reference surface, and machining the bolting surfaces of said web accurately normal to said supporting reference surface.

2. The method of claim 1 wherein said bead seats are deformed sequentially by individually actuated jaws.

3. The method of claim 2 wherein said individually actuated jaws are held in their bead seat deforming condition and are used as the reference surface.

4. The method of claim 1 wherein said machining step is performed by end milling on an axis precisely normal to the imaginary plane defined by said reference surface.

5. The method of claim 4 wherein said deforming and machining steps are done in the same apparatus, using common wheel supporting means.

6. The method of claim 4 wherein said machining step is preceded by: moving at least one gauging switch normal to said reference surface until its switch is actuated by the web to provide a second reference plane, and carrying out said machining step to a predetermined distance from said second reference plane.

7. The method of claim 6 wherein the moving of the gauging switch is done against the side of the web opposite the side being milled.

8. The method of claim 7 wherein a plurality of gauging switches are moved against the web, and utilizing the position of the last of said gauging switches that is actuated to establish the second reference plane.

9. A method of truing a wheel having a rim with inner and outer bead seats and a web having a bolting surface for fastening onto a hub, said method comprising: forming a rim with outer and inner bead seats of slightly larger diameter than desired, forming a web that has inner and outer side surfaces to fit inside said rim, securing said web coaxially to said rim with its inner and outer side surfaces adjacent inner and outer bead seats, forcing predetermined spaced apart bead seat dies radially inwardly to deform said inner and outer bead seats to a reduced final diameter, supporting opposing inner and outer machining heads coaxially of each other and with respect to said bead seat dies for movement axially towards each other, advancing one of said heads toward one side surface of the web to within a predetermined distance of the web while said bead seat dies support the bead seats in their final reduced diameter condition, feeding said one of said heads toward the web for a predetermined distance while machining the web, stopping the feeding and machining action of said one of said heads while holding the head against the web and while holding said bead seat deforming dies against said bead seats, feeding the other one of said heads axially into engagement with the opposite side surface of the web while holding the bead seat dies against said bead seats, and stopping said other head at a predetermined spacing from said one of said heads.

10. The method of claim 9 wherein the steps of stopping the feeding and machining action of said one of said heads are done sequentially to true the machined surfaces.

11. The method of claim 10 wherein said advancing and feeding steps for said one of said heads are controlled by web sensing feelers mounted on said one of said heads.

12. The method of claim 11 wherein said feeding step for said other of said heads is controlled by stop sensing feelers mounted on said other one of said heads.

13. A method of truing a wheel having a rim with opposing bead seats adjacent opposite side edges and a web extending generally normal to the rim and having bolting surfaces thereon, said method comprising: position the wheel with one side edge of said rim resting on a generally planar surface, forcing a first set of dies radially inwardly along a plane parallel to said generally planar surface and against a bead seat to true up said bead seat, forcing a second set of dies radially inwardly along a plane parallel to said generally planar surface against the other one of said bead seats to true up the other bead seat, and causing annularly disposed surfaces of said wheel to be formed accurately normal to said trued bead seat surfaces.

14. The method of claim 13 wherein said generally planar surface is formed of a resilient material which will accommodate deformation of the rim into its surface.

15. The method of claim 13 wherein said forcing steps are done sequentially.

16. The method of claim 13 wherein said causing step is performed by a machining operation while said forcing steps are exerting radially inward pressure on said bead seats.

17. The method of claim 16 wherein said machining operation is performed on said web.

18. The method of claim 17 wherein said machining operation is performed on the side of the web to provide a bolting surface for supporting the wheel and which bolting surface is accurately made relative to the bead seats.

19. A method of manufacturing a wheel having a rim with opposing beads for supporting a tire and a web secured thereto, and which web has a bolting surface for mounting onto a hub, said method comprising: forming a rim of slightly larger diameter than desired, forming a web with a bolting surface of a thickness to provide machineable metal, attaching said web to said rim with an angular accuracy with respect to the rim falling within said machineable metal thickness of said bolting surface, spreading said beads to the desired spacing while also deforming said rim radially inwardly to its desired diameter, holding said rim in its deformed condition, and machining said bolting surface in fixed relationship to said deformed beads while the wheel is so held.

20. A method of manufacturing a welded wheel having a rim with opposing beads for supporting a tire and a web supporting said rim, which web has a bolting surface for fastening onto a hub, said method comprising: forming a rim of slightly larger diameter than desired, forming a web to fit inside of said rim, welding said web to said rim, sequentially moving two generally parallel bead deforming members radially inwardly against said rim to work first one side of said rim and weld and then the other before bringing both beads to the same diameter.

21. The method of claim 20 wherein said web butts the inside of said rim and said weld is a butt weld.

22. A method of manufacturing a welded wheel having a rim with opposing outer and inner beads for supporting a tire, and a web with a peripherally bent flange pressed into the rim, and which web has a bolting surface for fastening onto a hub, said method comprising: forming a rim with outer and inner beads of slightly larger diameter than desired, forming a web with an inwardly bent peripheral flange, pressing said web into said rim with the peripheral flange positioned adjacent the outer bead, moving two generally parallel bead deforming members radially inwardly against said rim with the bead deforming member that is adjacent said outer flange trailing the other of said bead deforming members before deforming both beads to their final condition, and machining said bolting surface of said web while said bead deforming members hold the beads in their final deformed condition.

23. A method of fabricating a wheel having a rim with opposing outer and inner beads and a web having a bolting surface for fastening onto a hub, said method comprising: forming a rim with outer and inner bead seats of slightly larger diameter than desired, forming a web that has inner and outer side surfaces to fit inside said rim, securing said web coaxially to said rim with its inner and outer sides adjacent respective inner and outer beads, deforming said inner and outer beads inwardly to a final reduced diameter condition, moving a first set of rotating cutters axially against said outer surface of said web to machine surfaces thereon, stopping rotation of said cutter in their final cutting positions to support the wheel, and moving another set of rotating cutters axially against said inner surface to machine the bolting surfaces thereon to within a predetermined axial spacing of said first set of cutters and assure the predetermined spacing of the opposing machined surfaces and their alignment with said inner and outer beads.

* * * * *